US005718947A

United States Patent [19]

Martin et al.

[11] Patent Number: 5,718,947

[45] Date of Patent: Feb. 17, 1998

[54] PROCESSES FOR FORMING THIN, DURABLE COATINGS OF CATION-CONTAINING POLYMERS ON SELECTED SUBSTRATES

[75] Inventors: Charles W. Martin, Central, S.C.; Stan H. Baker, Lake Jackson, Tex.; Terry D. Gordon, Angleton, Tex.; Melisa Davila, Lake Jackson, Tex.

[73] Assignee: The Dow ChemicalCompany, Midland, Mich.

[21] Appl. No.: 530,645

[22] Filed: Sep. 20, 1995

Related U.S. Application Data

[63] Continuation-in-part of Ser. No. 404,476, Mar. 14, 1995, abandoned.

[51] Int. Cl.[6] ..... B05D 5/00

[52] U.S. Cl. ..... 427/243; 427/245; 427/388.5; 427/389.7; 427/388.1; 427/389.9; 427/393.5; 427/407.2; 427/409; 427/412; 427/412.3; 427/412.4; 521/27; 521/25; 521/31

[58] Field of Search ..... 427/243, 245, 427/388.5, 388.1, 389.7, 389.9, 393.5, 407.2, 409, 412, 412.3, 412.4; 521/25, 30, 31, 33, 27

[56] References Cited

U.S. PATENT DOCUMENTS

| | | | |
|---|---|---|---|
| 3,072,618 | 1/1963 | Turbak | 260/79.3 |
| 3,772,059 | 11/1973 | Shikada | 427/246 |
| 3,799,901 | 3/1974 | McCann et al. | 260/29.6 |
| 4,169,024 | 9/1979 | Fang | 204/98 |
| 4,243,504 | 1/1981 | Fang et al. | 204/296 |
| 4,262,041 | 4/1981 | Eguchi et al. | 427/245 |
| 4,348,310 | 9/1982 | Silva et al. | 524/167 |
| 4,433,082 | 2/1984 | Grot | 524/755 |
| 4,453,991 | 6/1984 | Grot | 156/94 |
| 4,454,176 | 6/1984 | Buckfelder | 427/246 |
| 4,661,411 | 4/1987 | Martin et al. | 428/421 |
| 4,666,573 | 5/1987 | DuBois et al. | 204/98 |
| 4,680,101 | 7/1987 | Darlington et al. | 204/295 |
| 4,720,334 | 1/1988 | DuBois et al. | 204/296 |
| 4,731,263 | 3/1988 | Martin et al. | 427/385.5 |
| 4,990,252 | 2/1991 | Tomaschke et al. | 427/246 A |
| 5,082,697 | 1/1992 | Patton et al. | 427/340 |
| 5,136,474 | 8/1992 | Sarangapani et al. | 361/502 |
| 5,206,279 | 4/1993 | Rowland et al. | 524/379 |

OTHER PUBLICATIONS

Salt effect on perfluorinated ionomers solutions; Polymer preparation (ACS) vol. 32, No. 1 p. 612 No Date Available.

Thin and composite high–flux membranes of perfluorosulfonated ion–exhange polymer vol. 54, pp. 51–61; Journal of Membrane Science No Month Available.

Structure and related properties of solution–cast perfluorosulfonated ionomer films; Macromolecules 1987 vol. 20 pp. 1425–1428.

Dissolution of Perfluorinatd ion–containing polymers; Anal Chem. 1982 1639–1641 No Month Available.

Morphology and chemical properties of the Dow perfluorosulfoate ionomers; Macromolecules 1989 pp. 3593–3599 vol. 22 No Month Available.

Chemical and morphological properties of solution–cast perfluorosulfonated ionomers; Macromolecules 1988, p. 1334–1339 No Month Available.

Silane coupling agents for attaching nafion to glass and silica; Anal.Chem. 1986, pp. 661–662 No Month Available.

Rod like micellar structures in perfluorinated solutions J. Phys. France 1988, 2101–2109 No Month Available.

Swelling study of perfluorosulphonated ionomer membranes, Polymer 1993 vol. 34 No. 2 No Month Available.

Small angle neutron scattering of perfluorosulfonated ionomers in solution; Macromolecules 1986; pp. 2651–2653 No Month Available.

*Primary Examiner*—Kathryn L. Gorgos

[57] ABSTRACT

Non-evaporative processes for coating ion-containing polymers onto selected substrates and the articles made thereby, which processes fundamentally comprise contacting a substrate with a dispersion or solution of an ion-containing polymer and especially a solventless dispersion of a perfluorosulfonic acid ionomer, and thereafter contacting the dispersion- or solution-wetted substrate with a solution of a salt or of a strongly ionizing acid of a sufficient concentration to cause an adherent coating of the ion-containing polymer to be formed on the substrate.

17 Claims, No Drawings

PROCESSES FOR FORMING THIN, DURABLE COATINGS OF CATION-CONTAINING POLYMERS ON SELECTED SUBSTRATES

CROSS REFERENCE TO RELATED APPLICATIONS

This application is a continuation-in-part of prior U.S. application Ser. No. 08/404,476, filed Mar. 14, 1995, now abandoned.

BACKGROUND OF THE INVENTION

The present invention relates to processes for forming thin coatings of ion-containing polymers on selected substrates, and to the articles made thereby. More particularly, but without limitation, this invention relates to processes for forming coatings of such polymers on such substrates, using a surface active dispersion of an ion-containing polymer which will wet the particular substrate to be coated.

Examples of the known ion-containing polymers include the sulfonated polystyrenes, copolymers of ethylene with alpha-beta unsaturated carboxylic acids such as acrylic acid or methacrylic acid and perfluorocarbon ionomers. The perfluorocarbon ionomers include those with sulfur-based functional groups, phosphorus-based functional groups and carboxylic acid or carboxylate functionality. All of these materials, with the exception of the phosphorus-based perfluorocarbon ionomers, are presently commercially-available.

The perfluorinated ionomers which have as the functional groups sulfonic acid groups or a salt thereof have been of particular interest, and commercial examples of such ionomers have been produced in the acid form by E. I. DuPont de Nemours & Co., Inc., under the Nafion™ trademark, where n is 1,2,3 etc. and the ratio of a:b is typically about 7 to 1:

$$-(CF_2-CF_2)_a(CF_2-\underset{\underset{O(CF_2CF(CF_3)O)_nCF_2CF_2SO_3H}{|}}{CF})_b-$$

The Dow Chemical Company has produced ionomers having a shorter side-chain (acid-form) structure wherein n is 0 in the preceding formula:

$$-(CF_2-CF_2)_a(CF_2-\underset{\underset{OCF_2CF_2SO_3H}{|}}{CF})_b-$$

The production of these ionomers is described widely in the literature, for example in U.S. Pat. Nos. 4,358,545 and 4,940,525, and is well known to those familiar with the perfluorinated ionomer art.

Dispersions of copolymers of a non-acid, ethylenically unsaturated monomer with an ethylenically unsaturated carboxylic monomer are well known in the art, and are described for example in U.S. Pat. Nos. 3,799,901 and 5,206,279, and in the references summarized therein. Ethylene-acrylic acid copolymers in particular are commercially available from The Dow Chemical Company under the mark Primacor™, which contain from 3 to 20 weight percent of the acrylic acid monomer.

Dispersions of ethylene acrylic acid copolymers are available from Morton International under the mark Adcote™, but can also be prepared by stirring a high acid polymer (typically 20 percent by weight of acrylic acid monomer) with a solution of aqueous ammonium hydroxide at from 95 to 110 degrees Celsius for from 30 to 90 minutes in a closed vessel. Typically, 0.8 moles of ammonium hydroxide is used per mole of acrylic acid to make a dispersion containing 25 percent by weight of ethylene acrylic acid copolymer. A surface active dispersion can be prepared therefrom for coating polytetrafluoroethylene, polyethylene or polypropylene, for example, by diluting 4 parts by weight of the 25 weight percent aqueous dispersion with 96 parts by weight of an equal mixture by weight of water and ethanol.

A partially sulfonated polystyrene (or SPS) can be prepared, for example, by the procedure outlined in U.S. Pat. No. 3,072,618. An SPS polymer prepared in this fashion and containing 1.2 meq/g of dry polymer will dissolve in 1,4-dioxane. A surface active solution or dispersion of the partially sulfonated polystyrene polymer can thereafter be prepared which by visual inspection provides a good coating on substrates like polytetrafluoroethylene, polyethylene and polypropylene, by diluting a 2 percent by weight solution of the polymer in 1,4-dioxane with an equal volume of deionized water.

Dispersions of the perfluorosulfonic acid ionomers and of the perfluorosulfonate ionomers have been made previously by processes as described for example in U.S. Pat. No. 4,731,263 to Martin et al. (salt form placed in solution or dispersion at 250 deg. Celsius and elevated pressures, then solvent removed at low temperature and resulting solids able to be redispersed at room temperature in a variety of solvents), U.S. Pat. No. 4,661,411 to Martin et al. (acid form of ionomer at 250 degrees Celsius, high pressures), United States Patents Nos. 4,433,082 and 4,453,991 to Grot and the references cited therein (acid or salt form), Moore and Martin, "Morphology and Chemical Properties of the Dow Perfluorosulfonate Ionomers", *Macromolecules*, vol. 22, pp. 3594–3599 (1989), and Moore and Martin, "Chemical and Morphological Properties of Solution-Cast Perfluorosulfonate Ionomers", *Macromolecules*, vol. 21, pp. 1334–1339 (1988). Dispersions of the Nafion™ ionomers are also available commercially in various equivalent weights which employ a lower alcohol/water combination as the liquid medium or solvent.

Thin films have previously been formed using these perfluorocarbon ionomer dispersions by evaporative coating techniques on various substrates, as best seen for example in the aforementioned Martin and Grot patents (suitable substrates being catalyst supports such as alumina, silica, zeolites, carbon etc., perhalocarbon- or glass-containing fabrics, ion exchange membranes or porous diaphragms, and wire or wire mesh electrodes), in U.S. Pat. Nos. 4,680,101 to Darlington et al. and 4,720,334 to DuBois et al. (on a diaphragm support), and in Szentirmay et al., "Silane Coupling Agents for Attaching Nafion to Glass and Silica" (on glass), Analyt. Chem., vol. 58, No. 3, pp. 661–662 (March 1986).

None of the coatings produced by these earlier processes, however, have been entirely satisfactory. Especially in the case of substrates having an uneven or irregular surface to be coated, excessive amounts of the ionomer have been required to be employed to assure complete coverage of the substrate. The durability and strength of adhesion to the underlying substrate of these coatings have also been less than desired.

SUMMARY OF THE INVENTION

The present invention concerns novel and improved processes for forming thin coatings of ion-containing polymers and especially of the perfluorosulfonate salt form ionomers on selected substrates, which comprise contacting the substrate with a colloidal, surface active dispersion of an ion-containing polymer and then contacting the dispersion-wetted substrate (while still wetted with the colloidal dispersion or solution) with a solution of a salt or of a strongly ionizing acid which is of a sufficient concentration to cause an adherent coating (which may be continuous but is not necessarily so) of the ion-containing polymer to be formed on the surface of the substrate. This coating is typically on the order of less than 100 nanometers thick, and desirably is on the order of 5 to 10 nanometers thick.

An optional additional step may involve exchanging the cation of the ionomer after this initial salt or acid solution-contacting step, as by contacting the dispersion-wetted substrate with the same or a different salt solution, for example with a potassium salt solution rather than a sodium salt solution, where the newly-exchanged form of the ionomer is less effective than the original form in coating the substrate initially but is more amenable to a particular end use or to further processing, or possesses a quality or property more fully than the original salt or acid form.

A further optional step may include treatment of the coated substrate at an elevated temperature to provide improved coating adhesion to the substrate or for other purposes, as will be described below. Those skilled in the art will understand, parenthetically, that the "dispersions" in question have certain characteristics of true solutions, as noted in U.S. Pat. No. 4,433,082 to Grot; "dispersions" is consequently not to be construed as limiting of these liquid compositions of ion-containing polymers.

Thus, those amphiphatic ion-containing polymers which may be placed in surface active dispersions generally are of interest, and the ion-containing polymers with low ionic functionality (for example, containing less than 20 mole percent of the ionizable monomer) are particularly of interest for forming essentially continuous coatings on a variety of substrates. Ion-containing polymers which when formed into a dispersion or solution do not wet out a given substrate to this extent, that is, which do not provide a contact angle with the dispersion- or solution-wetted substrate approaching zero, are also useful but are much less preferred.

The acid solutions which can be used to subsequently contact a dispersion- or solution-wetted substrate according to the inventive processes include aqueous solutions of those acids which are conventionally known or classified in the art as "strong" acids, for example, nitric acid, hydrochloric acid or sulfuric acid.

Preferably, however, a salt solution will be employed. The optimum salt concentration in the salt solution employed in a given embodiment depends on the salt being used, but typically is in excess of about 1 percent by weight of the salt solution and preferably is between about 5 percent by weight of the solution and saturation in the solution. Salts which have been found suitable for use in the present invention include cations such as hydrogen, alkali metals, alkaline earth metals and transition metals, ammonium and alkylammonium cations in water-soluble combinations with any anion such as sulfate, fluoride, chloride, bromide, iodide, carbonate, phosphate, acetate, hydroxide, nitrate or thiocyanate. For perfluorocarbon ionomer coatings, more particularly, sodium chloride, sodium carbonate, sodium acetate and sodium bisulfate have all been found especially useful in forming essentially continuous coatings on substrates such as polytetrafluoroethylene (PTFE), although as suggested above, it may be desirable after forming the coating initially to exchange a different cation for the sodium in the ionomer through contacting the sodium-exchanged, perfluorosulfonate ionomer coating with a solution of the cation. Particular examples of instances wherein it would be advantageous to perform this additional step will be given hereafter.

As has also been suggested above, the durability and strength of adhesion of the ionomer coating are enhanced in preferred embodiments of the invention by annealing at an elevated temperature. The optimum annealing temperature to be employed in any given application will depend on the structure of the ionomer, the counter ion and the thermal properties of the substrate. In general, however, the greatest improvement in adhesion to a polymeric substrate is realized by annealing the coating at a temperature which is near the ionic glass transition temperature (Tg) of the ionomer in question or near the Tg or crystalline melt point of the polymeric substrate, but below the decomposition temperatures of the ionomer and substrate.

In certain applications of the present invention, for example, where the performance or properties of the coated substrate are known to be or expected to be thickness-dependent to some extent, it will be desirable to employ more than one coating of ionomer. The processes of the present invention can be adapted to provide a plurality of such coatings on a selected substrate by contacting the coated substrate with a second, salt solution involving a different cation to increase the contact angle of the coated substrate prior to applying an additional coating of ionomer (in the manner used in applying the initial coating, namely contacting with the dispersion and then with the first, original salt solution), and by heat treating the coated substrate to further raise the contact angle. Or, the heat treatment step alone may suffice to raise the contact angle of the substrate to an extent such that an additional coating may be applied. This heat treatment will generally be conducted at a temperature lower than that recommended for the annealing, adhesion-enhancing step, and preferably following deposition of the final coating the annealing step will be performed.

The ionomers which will be preferred for use in coating a particular substrate will depend on the context of the coated article's application and use. For example, where chemical and thermal stability are necessary or desired properties, the perfluorocarbon ionomers are generally to be preferred, whereas in other applications and uses not requiring the chemical and thermal stability of these materials the sulfonated polystyrenes and ethylene-acrylic acid copolymers are generally to be preferred by virtue of their lower cost.

For the particular applications and uses contemplated herein, however, it is considered that preferred embodiments of the coating processes and coated articles of the present invention will be based on colloidal, surface active dispersions of a perfluorosulfonic acid ionomer or perfluorosulfonate ionomer. Ionomers which are of the type sold by E. I. DuPont de Nemours & Co., Inc. under the Nafion™ mark are suitable, as are the shorter side chain sulfur-based ionomers sold by The Dow Chemical Company and described by structural formula above. The Dow Chemical Company's shorter side chain ionomers are presently more preferred where maximum ionic content and surface wettability are desired, and more generally are preferred for their adaptability to a novel, solventless (organic) perfluorocarbon ionomer coating process which is described more particularly below.

Dispersions are commercially available or have been made previously using perfluorosulfonic acid or perfluorosulfonate ionomers of various equivalent weights, but preferably the perfluorinated ionomers employed herein will possess equivalent weights in the range of from about 500 to about 1500, and most preferably will possess equivalent weights in the range of from about 550 to about 1200.

Any known method for making colloidal dispersions of ionomers having these equivalent weights may suitably be employed, for example, dissolving solid ionomer in a mixture of water and a lower alcohol (for example, ethanol or propanol) at elevated temperatures and pressures in a closed vessel (such method being described in the aforementioned U.S. Pat. No. 4,433,082 to Grot). Commercially-available dispersions may also be used of Nafion™ ionomer in a lower alcohol/water solvent system at these equivalent weights.

Preferably, however, dispersions will be prepared from at least certain of these ionomers for coating a selected substrate which employ water only as the solvent. The use of a completely water-based dispersion is preferable in that the flammability, inhalation and emission/environmental concerns associated with an ethanol/water solvent system, for example, are not present with water as the solvent for these dispersions.

The shorter side chain ionomers produced by The Dow Chemical Company are especially preferred for use in the context of a solventless coating process, as has been mentioned previously, because they have proven amenable at equivalent weights of from about 550 to about 1000, and especially at equivalent weights of from about 550 to about 800, to being dispersed in water alone in high yields (where the yield is defined as the amount of ionomer solids which are effectively dispersed into the liquid solvent divided by the total amount of ionomer solids attempted to be dispersed) and under moderate conditions.

In this regard, the '082 patent to Grot does contemplate the possibility of making dispersions of up to 10 percent by weight of perfluorosulfonic acid form ionomers in water alone (the ionomers having equivalent weights in the range of 1025 to 1500), at temperatures of at least 240 degrees Celsius in a closed vessel with stirring. The examples illustrating this process show pressures of upwards of 370 pounds per square inch, and yields in room temperature dispersions of about 27 percent (after 100 hours agitation at 240 degrees and 370 psi) and of 48 percent (after 18 hours at 235 degrees Celsius).

By contrast, room temperature dispersions containing from about 1 to about 3 weight percent of the aforementioned lower equivalent weight, acid form shorter side chain ionomers can be prepared in the context of a solventless (organic) coating process of the present invention with stirring in a closed vessel at temperatures of from about 170 to about 200 degrees Celsius, a pressure of from about 110 pounds per square inch, absolute (psia), and over a time frame of from about 1 to about 3 hours with yields on the order of from about 70 percent to about 95 percent or greater being demonstrated for an 800 equivalent weight ionomer. Preferably, a powdered ionomer in the desired equivalent weight is combined with water in a closed vessel, and heated to a temperature of from about 180 to about 185 degrees Celsius with stirring for about 2 hours, with the pressure being on the order of 145 to about 165 psia.

The substrates which may be coated with ionomers according to the process of the present invention are numerous, and may desirably include for example fibers, powders, fabrics, articles or items of polytetrafluoroethylene, polyvinylidene fluoride, fluorinated ethylene-propylene copolymers (FEP), poly(vinyl chloride), glass, polypropylene, carbon, steel, platinum, chlorotrifluoroethylene or perfluoroalkoxyvinyl ether-tetrafluoroethylene copolymers (such as are sold under the designation Teflon PFA™ by E. I. DuPont de Nemours & Co., Inc.). Obviously, since the present invention is concerned with coatings, articles which comprise an outer layer or coating of any of the aforementioned substrate materials may also suitably be coated with an ionomer dispersion according to the present invention. In still more general terms, it is considered that the process of the present invention can be used to provide an ionomeric coating as a transition surface between any two materials whose surfaces form (in the absence of the ionomeric coating) a high surface energy interface.

One notable example of such an interface would be the interface between a fluoropolymer matrix material and reinforcing filler materials such as carbon, ceramics or glass that are often used in PTFE to reduce cold creep, lower the coefficient of thermal expansion and improve compressive strength over an unfilled PTFE in the context of PTFE bushings, bearings and low dielectric circuit boards, for example. The present ionomer coating process offers a simple alternative to corona discharge or corrosive chemical treatments with, for example, sodium amide or sodium naphthide that are often used to make fluoropolymer surfaces more wettable and thus more bondable.

As for other specific useful applications of the present invention, in the context of proton exchange membrane fuel cells, the catalytic sites must be accessible to the reacting gases and to a proton conductor. A thin (for example, less than a micrometer in thickness) coating of a perfluorocarbon ionomer on a catalyst (supported or unsupported) would provide a proton conductor without impeding gas diffusion to the catalyst-ionomer interface. The perfluorocarbon ionomer coating enabled by the present invention could also be used in the preparation of electrolytic capacitors such as those described in U.S. Pat. No. 5,136,474 to Sarangapani et al to provide maximum proton conductivity and maximum interfacial area.

A particularly preferred application of the present invention, however, is for placing an ionomeric coating or plurality of such coatings, and especially a perfluorocarbon ionomer coating or coatings, on polytetrafluoroethylene (PTFE) fibers and/or powders to make the PTFE fibers and/or powders water-wettable. In this regard, PTFE possesses a number of desirable attributes, including excellent chemical stability. A significant barrier has existed, however, to the use of PTFE in certain applications, for example in the development of nonasbestos diaphragms for chlor-alkali cells, due to the hydrophobic nature of PTFE.

Various efforts have been made to compensate for or to overcome the hydrophobic character of PTFE in chlor-alkali diaphragms through the incorporation of ion-exchange materials. An example of these efforts may be found in U.S. Pat. No. 4,169,024 to Fang, wherein PTFE (or a similar fluoropolymer) in the form of a powder or fibers, in an unsupported porous or nonporous film, in a coating on an inert fabric or in a porous reinforced structure (that is, a diaphragm) is chemically modified by reaction with a sulfur- or phosphorus-containing compound.

U.S. Pat. No. 4,720,334 to DuBois et al. is also representative, and describes diaphragms containing from 65 to 99 percent by weight of a fibrillated fluorocarbon polymer such as PTFE and from 1 to 35 percent of fluorocarbon ionomer (preferably containing carboxylic acid, sulfonic acid, alkali metal carboxylate or alkali metal sulfonate functionality) based on the combined weight of fibrillated fluoropolymer and ionomer, and optionally further containing wettable inorganic particulate material. The diaphragm is dried and secured upon an underlying cathode by being heated to a temperature below the sintering temperature of PTFE for a time. The ionomer can be incorporated in the diaphragm by codeposition from a slurry with the ionomer being included as a solid, gel or solution, by being coated on either or both of the fluorocarbon fibrils and inorganic particulate and then deposited from a slurry, or by being extruded in admixture with the fluoropolymer before it is fibrillated. Specific coating processes for coating the PTFE fibrils are described, including mixing PTFE powder with a solution of ionomer in a water-miscible solvent under high shear conditions, then dispersing the coated fibrils by blending with water and some surfactant. Thereafter the materials are deposited onto the cathode from the resulting slurry.

According to one embodiment of a coating process of the present invention, in contrast, PTFE powders or fibers are initially mixed with a colloidal dispersion of a perfluorosulfonate ionomer which preferably is produced from the short side chain, acid form ionomer produced by The Dow Chemical Company and described above, and which has an equivalent weight of from about 550 to about 1200.

This colloidal dispersion can be made, for example, by acid washing a film of the acid-form ionomer, rinsing to neutrality with deionized water, and then converting the film to the sodium form of the ionomer by soaking in sodium hydroxide. The film is then rinsed to neutrality and oven-dried, after which a desired weight of the film is placed in a glass liner and mixed with a sufficient quantity of a suitable solvent, for example, a mixture of ethanol and water, to give a solution or dispersion having an ionomer concentration of preferably from about 5.0 percent by weight to about 7.0 percent by weight.

After sealing the liner in a stainless steel reactor, and purging with nitrogen, the reactor is stirred and heated to a temperature at least on the order of 160 degrees to about 180 degrees Celsius for from about 1 to about 3 hours, producing a pressure in a 1 liter reactor of about 180 to about 220 psig. The reactor is then allowed to cool, the excess pressure bled off and the contents filtered through a 60 to 80 micron fritted glass filter. The resulting concentrated dispersion is then diluted with the ethanol/water mixture to finally provide the desired and preferred dispersion containing 1 percent by weight of the perfluorosulfonate ionomer.

Alternatively (and preferably), perfluorosulfonyl polymers in powder form can be used instead of the aforementioned ionomer film, and the powders hydrolyzed in sodium hydroxide and dissolved and processed as described above. Other known methods of making a dispersion of the perfluorosulfonate ionomer can be used without limitation as well.

Contacting a powdered PTFE substrate with the alcohol/water based dispersion made by this process preferably involves mixing the dispersion and PTFE powder in a 0.015 to 1 ratio by weight of ionomer solids to PTFE, on a dry basis. This ratio can be adjusted appropriately to achieve a doughy, handleable mass. Where PTFE fibers, coupons or fabrics, etc., are involved, of course, these substrates may be sprayed with or dipped into the ionomer dispersion, and the excess allowed to drain before contacting with a salt solution.

The liquid coated substrate is then stirred directly and without drying into the salt solution (in the case of coated PTFE powders or fibers) or immersed (for coupons or the like) directly in the salt solution.

Suitable salt solutions are (for the coating of PTFE materials to make them water-wettable with the alcohol/water-based dispersions or the ionomer dispersions in water alone) formed from water and from the water-soluble salts of the alkali, alkaline earth or transition metals, strong acids, and the ammonium salts of ammonia, the primary, secondary, tertiary or quaternary amines. Preferred salt solutions are prepared from the water-soluble sodium and magnesium salts for forming an initial coating on PTFE, and of these (as has been previously indicated), sodium chloride, sodium acetate, sodium carbonate and sodium bisulfate are particularly preferred. For purposes of achieving maximum water-wettability or for adding subsequent coatings, it will be preferred to then contact the coated PTFE with a potassium or zinc salt solution, and for adding subsequent coatings to also heat treat at an elevated temperature, for example, up to 300 degrees Celsius for 20 to 30 minutes. Then the single-coated substrate is contacted with the dispersion, exposed to the sodium or magnesium salt solution, rinsed, exposed to the potassium or zinc salt solution, rinsed, heat treated and so on until the last coating is applied that is desired, with the final heat treatment being an annealing of the coated substrate.

The quality of an ionomer coating produced according to the present invention, as assessed by contact angle measurements on the coated PTFE substrate, is ultimately affected by the ionomer concentration in the colloidal dispersion, by the dispersion's solvent composition, and by the temperature, salt concentration and pH of the salt solution. Each of these variables interact with each other and with the salt type and the ionomer structure. It is expected, however, that those skilled in the art will be able to determine the optimum combination of these variables for a given application (including the coating of substrates other than PTFE and/or for purposes other than imparting water-wettability thereto) by following the approach of the illustrative Examples provided below.

For placing a coating of an 800 equivalent weight perfluorosulfonate ionomer (derived from The Dow Chemical Company's short side chain perfluorocarbon ionomer) on PTFE for making the PTFE essentially permanently water-wettable from an alcohol/water-based dispersion of the ionomer prepared as described above, it would appear at present that from 0.25 to 2.0 percent by weight of the ionomer should be dispersed in an aqueous ethanol solution containing from 25 to 100 volume percent of ethanol, and that the salt solution should ideally be from 16 to 25 percent by weight of sodium chloride in water.

For PTFE samples which are to be annealed, most preferably, this ionomer dispersion should contain about 1.6 percent by weight of ionomer in a mixture of about 63 percent by volume of ethanol in water, and the salt solution should be an about 25 percent by weight solution of sodium chloride in water at a temperature about 65 degrees Celsius.

For PTFE samples which are not to be annealed, the best results are seen with an ionomer dispersion containing about 1.8 percent of the perfluorosulfonate ionomer in a 60 percent/40 percent mixture of ethanol and water, and a salt solution of about 25 weight percent of sodium chloride in water at a temperature of about 55 degrees Celsius.

A solventless (that is, employing only water as the liquid medium of the dispersion) coating process of the present invention is preferred, and can be carried out in several ways depending on the ionomer type employed and the nature of the dispersion to be used. For example, for the shorter side chain ionomers produced by The Dow Chemical Company, an integrated coating process would initially and preferably involve the preparation of a dispersion in water of from about 1 to about 3 percent by weight of a perfluorosulfonic acid form ionomer having an equivalent weight of from about 550 to about 1000, and especially from about 550 to about 800 inclusive, by the procedure described above. Alternatively, an available alcohol/water-based dispersion could be conventionally processed to remove the alcohol. Where the ionomer is a perfluorosulfonic acid ionomer of the Nafion™ type, initially a dispersion could be prepared in water of up to about 10 percent of an ionomer of an equivalent weight of from 550 to 1500, according to the process and under the conditions specified in U.S. Pat. No. 4,433,082 to Grot, or more commonly a commercially-available alcohol/water-based dispersion will again be conventionally processed to remove the alcohol.

The resulting dispersion is then added to a PTFE powder, for example, which will preferably have been subjected to intensive shearing in water to produce uniformly-sized PTFE particles, or to preferably presheared PTFE fibers, or to a mixture of PTFE in powder/granular form and in the form of fibers. The mixture is then subjected to high shear conditions generally corresponding to a blade tip speed on the mixer used of 800 ft./minute (240 meters/minute) or greater, for a time sufficient to coat the PTFE substrate with the ionomer and achieve a uniform slurry, with care being taken to not create such heat by excessive mixing/shearing as might cause the coated PTFE to begin to clump together. It is important to note specifically here that the liquids in question are to be added to the PTFE, as opposed to the PTFE being added to the water or dispersion.

The resulting ionomer to PTFE solids ratio will generally be about 0.005 to 1 by weight or greater, preferably being from about 0.005 to 1 to about 0.015 to 1 and most preferably being approximately 0.015 to 1, with sufficient ionomer and PTFE being present for a given volume of water to achieve adequate shearing of the solids and coating of the PTFE by the ionomer. This minimum solids level can reasonably be expected to vary with different tip speeds and different mixing conditions and with different equipment, but can be determined through routine experimentation.

Those skilled in the diaphragm art will appreciate at this point, that because there is no need for a rinse step to remove the lower alcohol solvent from the coated PTFE material, the ionomer coated PTFE may thereafter be contacted in situ with the requisite salt solution, in the draw vat for drawing a nonasbestos diaphragm. Alternatively, for other applications and uses the coated PTFE may be removed from a salt solution, rinsed with water to remove excess salt and air-dried. Most preferably, however, the coated PTFE for such other applications and uses is kept wetted after the optional rinse step, in that coated PTFE which has been dried generally requires vigorous agitation or stirring to be rewetted.

Both of the above-described coating processes (that is, involving coating from a dispersion of ionomer in an organic solvent (commonly a lower alcohol) and water, and from an ionomeric dispersion prepared in water only or from which the organic solvent has been removed) produce an evenly thin ionomeric coating which is sufficiently durable to be rinsed in water without being substantially removed, but which can be removed with mechanical abrasion.

As indicated previously, the durability and strength of adhesion of the ionomer coating can be enhanced (to the point where the coating may not be removed with hand rubbing) where desired for a given use or application, by annealing the coated substrate at an elevated temperature below the decomposition temperature of the ionomer coating. The optimum annealing temperature in a given application is, again, generally dependent on both the structure and salt form of the ionomer and on the nature of the substrate. Adhesion of the coating to the substrate is generally improved by annealing near or above the glass transition temperature of the ionomer. More preferably, for achieving the greatest adhesion and durability with the ionomer coating of a polymeric substrate, the annealing will occur near the glass transition temperature (Tg) of an amorphous polymeric substrate or near the crystalline melting point of a crystalline polymeric substrate. Thus, for PTFE coated with an 800 equivalent weight, shorter side chain perfluorosulfonate ionomer of the type made by The Dow Chemical Company (having an ionic Tg of about 250 degrees Celsius), the greatest degree of adhesion and durability is generally achieved with an annealing of the coated PTFE at a temperature of from about 330 to about 350 degrees Celsius for from one to 360 minutes, while for polyvinylidene fluoride substrates coated with the same ionomer, the preferred annealing conditions correspond to a temperature of from about 160 to about 170 degrees Celsius maintained for from one to 360 minutes.

It should be noted, however, that the benefits of enhanced adhesion may be offset to an extent in that with the re-orienting of the substrate surface under these conditions, some migration of the ionomer into the substrate can be expected with an attendant loss of some wettability, for example, in the sintering of a chlor-alkali diaphragm including ionomer-coated PTFE. Consequently, the adhesion and durability that can be achieved under selected annealing conditions for a given end use or application should be weighed against the effect of a decrease in wettability or some other property which may result, to determine whether it is desirable to achieve such enhanced adhesion and durability for the end use or application.

In the context of chlor-alkali diaphragms employing the above-described, preferred coated PTFE powder and/or fibers in some fashion, it has thus been found that these coatings in alkali metal perfluorosulfonate salt form are stable and remain wettable after exposure to the about 335 to about 350 degree Celsius temperatures at which the diaphragms are conventionally sintered and bonded, and that the coatings are essentially permanently adhered to the underlying PTFE substrate (to the point that ordinary cellophane adhesive tape applied to a coated and annealed PTFE coupon will not visibly remove the ionomer coating).

Those skilled in the art will appreciate from the foregoing that for substrates other than PTFE and for applications other than making PTFE water-wettable, different ionomers may be useful or desirable (having different backbone structures, different functionalities or being in different salt forms), ionomers of different equivalent weights may be useful or preferable, salt solutions for example of different compositions, temperatures and/or pH's may be useful or preferred, and annealing may not be appropriate or may appropriately involve different temperatures.

Because of the variety of substrates and ionomers which are contemplated herein, and because of the variety of applications and contexts in which the present ionomeric coatings are potentially useful as transition surfaces, it is not possible or useful to fully describe herein all of the possible combinations of substrates, ionomers, and applications which are of interest. It is considered, however, that these combinations can be practiced without the exercise of further inventive skill, given the teachings above and given the examples provided hereafter:

ILLUSTRATIVE EXAMPLES

Examples 1–4

An ionomer of the type produced by The Dow Chemical Company was prepared by copolymerization of $CF_2{=}CF_2$ with $CF_2{=}CFOCF_2SO_2F$ in an emulsion polymerization system. The resulting polymer was isolated, dried, pressed into a film and hydrolyzed with 25 wt. percent NaOH to give a perfluorinated sodium sulfonate form ionomer. After being water-washed to neutrality, the film which contained 1.25 milliequivalents of sulfonic groups per gram of dry weight was cut into small pieces and 5 parts by weight (on a dry basis) of these film pieces were placed in a stirred pressure vessel with 95 parts by weight of a mixture of equal parts by volume of ethanol and water. The vessel was then heated with stirring to 165 degrees Celsius for 4 hours. After cooling, the percent solids of the resulting dispersion was determined to be 5.1 wt. percent by evaporating a weighed sample to dryness and weighing the residue. The colloidal dispersion was colorless with a slight haze.

This dispersion was used to coat Teflon™ 7C PTFE powder, a strip of PTFE film, a polypropylene coupon and a steel coupon. For the powder, 100 grams of the powder were placed in a beaker and 700 grams of the dispersion added thereto. The mixture was agitated with a Lightning DS1010™ stirrer at 600 rpm for about 20 minutes until a uniform slurry was obtained. This slurry was vacuum filtered using a medium to coarse filter paper, and the wet cake placed in a solution of 5 weight percent of sodium carbonate in water at room temperature and allowed to stand for 15 minutes. The treated powder was then redispersed with the stirrer, and recovered by vacuum filtration. The filter cake was washed to neutrality by three iterations of dispersing the wet cake in deionized water with agitation in a high shear blender and recovering by vacuum filtration. The powder remained easily wettable throughout and would sink to the bottom of the blender when agitation was stopped, and was observed to rewet after drying by stirring with deionized water.

For comparison, a sample of the powder was treated with the ionomer dispersion, filtered and placed in a blender with deionized water. After blending for 2 minutes, the powder was observed to lose its wettability and coat the walls of the blender and to float on the surface of the water.

For coating the PTFE film, a ½ inch wide by three inches long strip of PTFE film was cleaned with acetone and deionized water, immersed for most of its length in the ionomer dispersion for about 10 seconds, removed and allowed to drain briefly, then immersed in a 5 weight percent solution of sodium carbonate in water at room temperature for about 10 seconds. The film was then washed with flowing deionized water to remove any loose material and excess salt, and treated with an aqueous solution of Safranine 0™ 3,7-diamino-2,8-dimethyl-5-phenyl-phenazinium chloride, cationic dye dispensed with an eye dropper. The ionomer treated area remained wetted throughout all of these steps and absorbed the dye, to leave a uniform reddish pink coloration which was not removed by rinsing with deionized water but which could be removed with adhesive tape or by rubbing. A coated PTFE film that was not immersed in the sodium carbonate solution dewetted and would not hold the dye.

The polypropylene coupon when coated with the dispersion and immersed in a 26 wt. percent solution of sodium chloride and water at room temperature provided a wettable, uniformly dyed surface by the same procedures, as did the degreased steel coupon which was coated and immersed in the same 26 wt. percent sodium chloride solution.

Example 5

A PTFE film was coated with the ionomer dispersion of Examples 1–4, immersed in a 5 weight percent solution of sodium carbonate in water at room temperature and the film rinsed to remove loose materials and excess salt, but the film was not treated with the dye.

The film was then annealed by heating slowly from room temperature to 350 degrees Celsius (for example, at about 20 degrees per minute) in a Hewlett-Packard 5880 gas chromatograph oven, and being held at this temperature for ½ hour before cooling to room temperature (typically over a span of from 10 minutes up to 2 hours).

After being cooled to room temperature, the film was treated with the Safranine 0™ 3,7-diamino-2,8-dimethyl-5-phenyl-phenazinium chloride, dye solution. The coated part of the film absorbed the dye and acquired a reddish-pink coloration which was not removed by adhesive tape or by rubbing.

The heat treated or annealed film (and more specifically the coated portion thereof) was observed to have a contact angle with water of about 100 degrees after cooling in air, of about 88 degrees after soaking in deionized water for 2 hours and of about 79 degrees after being immersed in deionized water for 20 hours at 70 degrees Celsius. An uncoated film that had gone through the same heat cycle was observed to have a contact angle with water of about 126 degrees on cooling, and this contact angle was essentially unchanged after soaking in water for 2 hours. It will consequently be preferred in the context of coating and annealing a PTFE substrate to provide water-wettability thereto, as for example in the manufacture of a chlor-alkali diaphragm, to employ a water soak or to rewet the annealed, coated PTFE by stirring in water before placing the diaphragm cell in operation.

The method used for making these contact angle measurements, and those made in subsequent examples below, involved equilibration of the particular annealed, coated PTFE coupon in water at ambient temperatures, generally over a period of 16 hours or so. Unannealed samples were rinsed after coating and left immersed in water until the contact angle was determined.

A given coated and salt solution-immersed PTFE coupon (annealed or unannealed) was thereafter removed from its deionized water soak and patted dry, then placed on the stage of a Kernco Contact Angle Meter, Model G-1 contact angle measuring device; several measurements (10 to 14 measurements) were taken of the contact angle with water of the coated coupon on this device. Where the coupon in question would not lie flat on the device, ¼ inch diameter disks were cut therefrom using a hole punch and the contact angles determined on the sides of the disks which had not been exposed to the punch. Two measurements were made using the opposite edges of each disk, and the measurements averaged as with the coupons.

Examples 6–20

A designed experiment was carried out to determine the effect of various conditions in coating the ionomer dispersion of the previous examples on PTFE, with respect to the contact angle of the coated PTFE with water. The variables explored were ionomer concentration in the dispersion (in the range of from 1 to 5 percent by weight in a mixture of equal parts by volume of ethanol and water), the concentration of sodium chloride in the aqueous salt solution (from 1 to 25 percent in water), and the effect of performing more than one ionomer coating cycle without performing a heat treatment in between these coatings. All of the solutions were at room temperature (approximately 25 degrees Celsius).

In terms of the general procedures followed in this designed experiment, the PTFE coupons to be coated were initially washed in acetone, rinsed with deionized water and dried. Thereafter, the coupons were immersed in the ionomer solution, removed from the ionomer solution and allowed to drain for from 5 to 10 seconds, then immersed in the salt solution. The coupons were then removed and rinsed in deionized water. If a second coating was to be applied, these steps were repeated without drying. The coupons were then air dried and annealed by heating to between 335 and 345 degrees Celsius and holding at this temperature for 30 minutes. After cooling, the coupons were soaked in deionized water overnight. The coupons were removed from the deionized water, patted dry and the contact angle with water determined in the manner described above. The conditions and results from these various coupons are shown below in Table 1, along with measurements conducted on uncoated, annealed and uncoated, unannealed PTFE coupons for comparison. Based on a statistical analysis of the data therein, the optimum water-wettability is predicted to be obtained with a dispersion containing 1 percent by weight of ionomer and a salt solution of 25 weight percent of sodium chloride in water. A second ionomer coating was not observed to have a beneficial effect in the region of the minimum contact angle, absent a heat treatment between coatings.

TABLE 1

| Sample | Ionomer Concentration (Wt. Pct.) | Salt Concentration (Wt. Pct.) | Contact Angle (Avg., Degrees) | Std. Deviation |
|---|---|---|---|---|
| Uncoated, Unannealed PTFE | NA | NA | 111.2 | 2.10 |
| Uncoated, Unannealed PTFE | NA | NA | 102.3 | 2.56 |
| Uncoated, annealed PTFE | NA | NA | 128.8 | 3.19 |
| Uncoated, annealed PTFE | NA | NA | 134.9 | 1.64 |
| Uncoated, annealed PTFE | NA | NA | 128.8 | 2.76 |
| 2 Coats, Annealed | 1.0 | 25.0 | 92.5 | 7.05 |
| 1 Coat | 1.0 | 13.0 | 105.1 | 16.28 |
| 2 Coats | 1.0 | 1.0 | 123.9 | 6.53 |
| 3 Coats | 1.0 | 13.0 | 118.0 | 10.67 |
| 1 Coat | 3.0 | 25.0 | 108.5 | 12.98 |
| 3 Coats | 3.0 | 1.0 | 124.7 | 4.57 |
| 2 Coats | 3.0 | 13.0 | 117.3 | 10.89 |
| 2 Coats | 3.0 | 13.0 | 105.3 | 10.49 |
| 3 Coats | 3.0 | 25.0 | 116.6 | 7.18 |
| 2 Coats | 3.0 | 13.0 | 114.1 | 8.57 |
| 1 Coat | 3.0 | 1.0 | 129.4 | 4.74 |
| 2 Coats | 5.0 | 1.0 | 117.3 | 13.05 |
| 1 Coat | 5.0 | 13.0 | 103.2 | 27.20 |
| 2 Coats | 5.0 | 25.0 | 109.9 | 16.22 |
| 3 Coats | 5.0 | 13.0 | 98.4 | 8.39 |

Examples 21–35

A second designed experiment was carried out to determine the effects of the temperature of the salt solution, of the alcohol (ethanol) concentration in the ionomer dispersion and of the ionomer concentration in the dispersion on the measured contact angle of PTFE coupons coated and annealed as in previous examples. A single coating was applied in all instances, and the salt concentration held constant at 25 percent by weight of sodium chloride in water.

The combinations associated with these coupons and the results of contact angle testing thereon are shown in Table 2 below:

TABLE 2

| Ionomer Concentration (Wt. Pct.) | Ethanol in Dispersion (Vol. Pct.) | Salt Solution Temp. (Deg. C.) | Contact Angle (Avg, Deg.) | Std. Deviation |
|---|---|---|---|---|
| 1.75 | 50.0 | 25.0 | 107.30 | 6.78 |
| 1.00 | 75.0 | 25.0 | 98.00 | 5.68 |
| 1.00 | 25.0 | 25.0 | 112.20 | 12.42 |
| 0.25 | 50.0 | 25.0 | 118.14 | 5.60 |
| 1.75 | 25.0 | 45.0 | 103.10 | 9.79 |
| 1.00 | 50.0 | 45.0 | 108.00 | 8.30 |
| 0.25 | 75.0 | 45.0 | 128.28 | 4.25 |
| 1.75 | 75.0 | 45.0 | 95.71 | 6.78 |
| 0.25 | 25.0 | 45.0 | 116.00 | 10.40 |
| 1.00 | 50.0 | 45.0 | 82.50 | 9.73 |
| 1.00 | 50.0 | 45.0 | 98.50 | 8.31 |
| 1.00 | 75.0 | 65.0 | 92.50 | 8.75 |
| 1.75 | 50.0 | 65.0 | 87.21 | 5.47 |
| 1.00 | 25.0 | 65.0 | 95.57 | 20.87 |
| 0.25 | 50.0 | 65.0 | 121.80 | 5.50 |

The data in Table 2 show that the contact angle is lowered, and wettability improved, by heating the salt solution in the exemplified process to a temperature of 65 degrees Celsius, and further suggest that at this temperature the optimum ionomer concentration should be near 1.5 percent by weight of the dispersion, with the optimum alcohol concentration in the dispersion being 63 percent by volume of ethanol in water.

Together, the foregoing examples show that the coating quality as measured by contact angle is optimum (under the conditions tested) for dispersions containing from 0.5 to 2.0 weight percent of the ionomer in 40 to 75 percent by volume of ethanol in water, and is improved by high sodium chloride concentrations and higher temperatures (that is, above about 65 degrees Celsius) in the salt solutions employed.

Examples 36–50

The designed experiment of Examples 21–35 was repeated on unannealed coated PTFE samples, with the results shown in Table 3. The contact angles for the unannealed coated PTFE samples are shown to be substantially lower than for the corresponding annealed, coated PTFE samples, but the effects and trends observed in Examples 21–35 are also observed in Table 3.

TABLE 3

| Ionomer Concentration (Wt. Pct.) | Ethanol in Dispersion (Vol. Pct.) | Salt Solution Temp. (Deg. C.) | Contact Angle (Avg, Deg.) | Std. Deviation |
|---|---|---|---|---|
| 1.75 | 50.0 | 25.0 | 93.08 | 6.05 |
| 1.00 | 75.0 | 25.0 | 83.50 | 6.20 |
| 1.00 | 25.0 | 25.0 | 99.00 | 6.87 |
| 0.25 | 50.0 | 25.0 | 100.00 | 4.84 |
| 1.75 | 25.0 | 45.0 | 79.33 | 5.51 |
| 1.00 | 50.0 | 45.0 | 79.91 | 8,11 |

TABLE 3-continued

| Ionomer Concentration (Wt. Pct.) | Ethanol in Dispersion (Vol. Pct.) | Salt Solution Temp. (Deg. C.) | Contact Angle (Avg, Deg.) | Std. Deviation |
|---|---|---|---|---|
| 0.25 | 75.0 | 45.0 | 105.16 | 4.68 |
| 1.75 | 75.0 | 45.0 | 76.75 | 6.71 |
| 0.25 | 25.0 | 45.0 | 90.16 | 6.27 |
| 1.00 | 50.0 | 45.0 | 77.16 | 4.85 |
| 1.00 | 50.0 | 45.0 | 89.00 | 10.88 |
| 1.00 | 75.0 | 65.0 | 91.58 | 8.26 |
| 1.75 | 50.0 | 65.0 | 69.91 | 10.49 |
| 1.00 | 25.0 | 65.0 | 97.08 | 12.00 |
| 0.25 | 50.0 | 65.0 | 89.41 | 6.03 |

Examples 51–56

Polytetrafluoroethylene coupons were coated in these examples with dispersions of the ionomer utilized in the preceding examples, at several different concentrations. The coated coupons were then exposed to a basic 5 weight percent solution of sodium carbonate ($Na_2CO_3$) in water at ambient temperature (25 deg. C.). The coupons were all then annealed as described previously. The contact angles were then determined for specimens that had and that had not been equilibrated (soaked) prior to measurement of the contact angle by immersion in deionized water. The results from these tests are shown in Table 4:

TABLE 4

| Ionomer Concentration (Wt. Pct.) | Equilibrated? | Contact Angle (Avg., Degrees) | Std. Deviation |
|---|---|---|---|
| 1.00 | Yes | 78.5 | 3.69 |
| 1.00 | No | 123.5 | 3.42 |
| 2.50 | Yes | 79.3 | 4.78 |
| 2.50 | No | 103.8 | 2.50 |
| 4.60 | Yes | 78.5 | 3.69 |
| 4.60 | No | 102.5 | 3.66 |

These data again suggest that the annealed, coated PTFE materials generally are improved in wettability after an initial period of equilibration in water, and that, in common with the earlier sodium chloride solution-immersed or -treated PTFE examples, for equilibrated materials beginning ionomer solids concentrations in the coating dispersion above 1 percent by weight do not yield appreciable improvements. These data also suggest that the 5 wt. percent sodium carbonate solution may preferably be used with the coated PTFE materials of these examples rather than the sodium chloride-based salt solutions employed in earlier examples.

Examples 57–76

Polytetrafluoroethylene coupons were coated with ionomer from dispersions having various solids concentrations as in previous examples, then immersed in one of several salt solutions at ambient temperature (25 deg. C.) and a pH of 7 or 12. The salt-form ionomers in these examples were exchanged with $Ca^{+2}$, $Mg^{+2}$, $Zn^{+2}$, $K^+$ or $Li^+$, with salt solutions being employed of the chloride salts of these cations or with a 26 weight percent sodium chloride salt solution being used, followed by conversion to the particular $Ca^{+2}$, $Mg^{+2}$, $Zn^{+2}$, $K^+$ or $Li^+$ exchanged ionomers by soaking in 0.5M solutions of the chloride salts of these cations for an hour. All specimens were rinsed and equilibrated in water before contact angle measurements were undertaken, and both annealed and unannealed specimens were prepared and tested.

The particulars of specimens prepared for determining the effect of $Ca^{+2}$ on the coated PTFE materials of the present invention, and the results therefrom, are as indicated in Table 5:

TABLE 5

| Sample | Ionomer (Wt. Pct.) | Salt Solution | pH | Contact Angle (Avg., Deg) | Std. Deviation |
|---|---|---|---|---|---|
| Annealed | 1.00 | NaCl | 12 | 104.4 | 8.81 |
| Annealed | 1.00 | NaCl | 12 | 104.3 | 2.97 |
| Unannealed | 1.00 | NaCl | 12 | 66.5 | 3.52 |
| Unannealed | 0.50 | NaCl | 12 | 80.5 | 4.21 |
| Unannealed | 0.25 | NaCl | 12 | 82.1 | 6.40 |
| Annealed | 1.00 | 20%. $CaCl_2$ | 7 | 109.2 | 2.89 |
| Unannealed | 1.00 | 20% $CaCl_2$ | 7 | 76.5 | 5.88 |

Those specimens associated with the study of $Mg^{+2}$ are described in Table 6, along with the results the contact angle testing conducted thereon:

TABLE 6

| Sample | Ionomer (Wt. Pct.) | Salt Solution | pH | Contact Angle (Avg., Deg) | Std. Deviation |
|---|---|---|---|---|---|
| Annealed | 1.00 | NaCl | 12 | 113.4 | 10.78 |
| Annealed | 1.00 | NaCl | 12 | 93.1 | 9.21 |
| Unannealed | 1.00 | NaCl | 12 | 85.2 | 5.67 |
| Unannealed | 0.50 | NaCl | 12 | 89.4 | 3.41 |
| Unannealed | 0.25 | NaCl | 12 | 87.4 | 4.23 |
| Annealed | 1.00 | 20% $MgCl_2$ | 7 | 97.2 | 6.54 |
| Unannealed | 1.00 | 20% $MgCl_2$ | 7 | 84.3 | 3.67 |

Those specimens associated with $Zn^{+2}$, $K^+$ and $Li^+$ are described in Table 7, along with the results of the contact angle wettability testing conducted thereon:

TABLE 7

| Sample/ Cation | Ionomer (Wt. Pct.) | Salt Solution | pH | Contact Angle (Avg, Deg) | Std. Deviation |
|---|---|---|---|---|---|
| Annealed/ Zn + 2 | 1.00 | 20% $ZnCl_2$ | 7 | 89.3 | 3.55 |
| Unannealed/ Zn + 2 | 1.00 | 20% $ZnCl_2$ | 7 | 69.3 | 6.00 |
| Annealed/K+ | 1.00 | 20% KCl | 7 | 86.3 | 4.90 |
| Unannealed/ K+ | 1.00 | 20% KCl | 7 | 84.5 | 7.96 |
| Annealed/ Li + 2 | 1.00 | 20% LiCl | 7 | 121.0 | 9.95 |
| Unannealed | 1.00 | 20% LiCl | 7 | 73.0 | 6.10 |

These examples suggest that a good degree of flexibility exists in the salt solution treatment step and in the application environment, and the results with calcium and magnesium in particular suggest that the presence of these materials in a chlor-alkali environment should not prove adverse to the use of, for example, coated PTFE in such an environment.

Example 77

Glass slides were cleaned by rinsing with acetone and deionized water, then air dried. The cleaned slides were coated by immersion in dispersions (in 50 vol. percent ethanol/50 vol. percent water) of various concentrations of the 800 equivalent weight ionomer (sodium salt, again) of previous examples. Excess ionomer dispersion was allowed to drain from the slides, and the slides immersed in a 25 weight percent NaCl salt solution, rinsed with deionized water and air-dried.

The coatings produced on the slides in this fashion were then analyzed for smoothness and coating thickness by X-ray photon spectroscopy, with the smoothness being determined by scanning across the coating's surface while measuring the atom percent of fluorine in the coating. The coating thickness was estimated by varying the angle of the X-ray photon spectroscopy beam while measuring the silicone signal observed through the coating.

The results are shown in Table 8 below. For comparison, the calculated atom percent of fluorine in a pure anhydrous 800 equivalent weight ionomer in sodium salt form is 64.4 percent.

TABLE 8

| Ionomer Concentration | Pct. Fluorine | | | Estim. Max. Thickness |
|---|---|---|---|---|
| (Wt. Pct.) | Min. | Max. | Delta | (nm) |
| 0.25 | 48.0 | 55.0 | 7.0 | 4.0 |
| 0.50 | 56.0 | 61.0 | 5.0 | 6.0 |
| 1.00 | 58.0 | 60.0 | 2.0 | 8.5 |
| 3.00 | 40.0 | 57.0 | 17.0 | * |
| 5.00 | 12.0 | 58.0 | 46.0 | * |

(*) Coatings were too uneven to estimate.

A sub-micron coating is evidently achieved, and the data suggest that the inventive process can produce coatings whose thickness approaches the dimensions of a Langmuir-Blodgett monomolecular film. The thickness and uniformity of the coating produced by this particular process and with this particular solvent and ionomer appear optimum at an ionomer concentration somewhere between 0.5 and 3.0 percent by weight of the dispersion.

Example 78

In order to determine the percentage utilization of ionomer in a film coating produced by a process of the present invention from a dispersion of a given concentration of ionomer in alcohol and water, glass slides (19 mm by 75 mm by 1 mm) were cleaned with acetone and water as in Example 77, and preweighed in a closed, clean widemouth jar.

These slides were then immersed to a fixed depth of 60 mm in a dispersion of a given concentration of the same ionomer as used in Example 77 and previous examples (thus providing a wetted area on each slide of 24.2 square centimeters). The slides were removed from the dispersions and allowed to drain for 10 seconds, and then touched to clean glass slides to remove excess, last drops of dispersion therefrom.

The wetted slides were then placed back in the wide mouth jar, which was then capped. The jar and coated slide contained therein were then reweighed for comparison to the observed precoated weight to determine the weight of the liquid film of the ionomer solution. The potential coating thickness was calculated in each instance by assuming that all of the ionomer present in the liquid film was deposited as a uniform coating on the glass surface. This calculated thickness was compared to the measured thickness from the previous example.

The results from this testing are shown in Table 9:

TABLE 9

| Pct. Ionomer (by Wt.) | Wt. of Ionomer Soln. (grams) | Ionomer Weight in Soln. (grams) | Potential Ionomer Thickness (nm, max.) | Measured Ionomer Thickness (nm, max.) | Ionomer Used in Coating (Pct.) |
|---|---|---|---|---|---|
| 0.93 | 0.0642 | 5.97E–04 | 123 | 8.5 | 6.9 |
| 0.50 | 0.0581 | 2.90E–04 | 60 | 6.0 | 10.0 |
| 0.25 | 0.0576 | 1.44E–04 | 29 | 4.0 | 13.7 |

Only a relatively small proportion of the ionomer was deposited on the slides from these dispersions. The excess ionomer can be rinsed away, and potentially recovered and recycled for forming additional coatings on various substrates.

Example 79

A small piece of platinum foil (1 cm. square in area) was picked up by one edge using forceps, and immersed to about ⅔ of its height in a dispersion in 50 vol. percent ethanol/50 vol. percent water) of 1 wt. percent of the 800 equivalent weight perfluorinated sodium sulfonate form ionomer employed in earlier examples. The foil was then removed and allowed to drain for 10 seconds. The drop left at the bottom of the platinum square was removed by touching the foil square to the rim of the bottle containing the dispersion, and the wetted foil was then fully immersed in a solution of sodium bisulfate (20 wt. pct.) in water. The foil was gently rinsed in a bottle of deionized water and then immersed in a dilute solution of Safranine 0™ 3,7-diamino-2,8-dimethyl-5-phenyl-phenazinium chloride, cationic dye. The treated ⅔ of the foil absorbed the dye and remained rose-colored and wetted after further rinsing with deionized water. The untreated (uncoated) ⅓ of the foil remained shiny and was water-beaded.

Examples 80–89

Coupons of PTFE were soaked in 1,1,1-trichloroethane, then rinsed with acetone and deionized water. These were then immersed in the dispersion of Example 79, removed from the dispersion and allowed to drain momentarily, then immersed in a nitric acid solution or in one of the aqueous salt solutions listed below in Table 10. After being rinsed by agitating in a beaker of fresh deionized water, the surface wettability of the coupons was assessed visually. If water formed a continuous film on the coupon without beading, the coupon was deemed wettable. The coupons were then immersed in a dilute solution of the Safranine 0™ 3,7-diamino-2,8-dimethyl-5-phenyl-phenazinium chloride, dye, and the quality of the coatings thereon compared by comparing color uniformity ("1" being indicative of the most uniform color observed, and higher numbers suggesting lesser degrees of uniformity). The results of these tests are shown in Table 10 as follows:

TABLE 10

| Salt | Wt. Pct. (in Water) | Wettable? | Color Uniformity |
|---|---|---|---|
| Sodium bisulfate | 20 | yes | 1 |
| Nitric acid | 70 | yes | 1 |
| Ammonium chloride | 20 | yes | 1 |
| Sodium acetate | 20 | yes | 2 |
| Tetrabutylammonium iodide | ca. 2.5 | yes | 3 |

TABLE 10-continued

| Salt | Wt. Pct. (in Water) | Wettable? | Color Uniformity |
|---|---|---|---|
| Sodium chloride | 25 | yes | 4 |
| Potassium chloride | 27 | yes | 5 |
| Silver nitrate | 20 | yes | 6 |
| Ferric nitrate | 18 | yes | 7 |
| Cetyltrimethylammonium chloride | 25 | yes | NA |
| Cetyltrimethylammonium chloride | 5 | no | NA |
| Cetylpyridinium chloride | 5 | no | NA |

The colors observed on these coupons ranged from a deep rose to a very pale pink, except that the coating deposited by the 25 percent by weight cetyltrimethylammonium chloride was essentially colorless. This variation is considered as reflecting the ease of exchanging the cationic dye into the coating. The sample immersed in nitric acid developed a bluish tinge as it dried.

With respect to the salt solutions, the results in Table 10 suggest that a wide variety of water-soluble salts can be used in the process of the present invention, but the results with the more concentrated and less concentrated surface active cetyl quaternary ammonium salts also suggest that the various useful water-soluble salts may be required to be employed in different concentrations to be effective for forming a satisfactory adherent coating on any given substrate.

Examples 90–91

A 0.92 weight percent dispersion of an ethylene-acrylic acid copolymer (containing 20 percent by weight of acrylic acid)) was prepared by diluting 1 part by weight of a commercially-available 25 percent by weight dispersion of such polymer (sold as Adcote 4983™ EAA dispersion by Morton International Inc., containing 25 weight percent solids neutralized with 0.8 equivalents of ammonium hydroxide per equivalent of acid), with 12.8 parts by weight of water and 13.3 parts by weight of ethanol. A PTFE coupon cleaned by acetone washing, deionized water rinsing and drying was immersed in part in the 0.92 per cent dispersion, the excess allowed to drain, the coated part immersed in a salt solution of 20 weight percent of sodium bisulfate in water and then water-rinsed. The treated portion of the coupon was clearly water-wetted. After exposure to Safranine 0™ dye, the treated portion showed a continuous area of very pale pink.

A clean PTFE coupon was immersed for comparison in a 1.0 weight percent solids dispersion in water alone (prepared by diluting 1.0 grams of the Adcote 4983™ material with 23.4 grams of deionized water), and drained of excess dispersion. The surface of the coupon was not wetted by the dispersion except for a few isolated drops, and when immersed in the sodium bisulfate solution, rinsed with deionized water and immersed in diluted Safranine 0™ 3,7-diamino-2,8-dimethyl-5-phenyl-phenazinium chloride, in water displayed only a few isolated spots of pink corresponding generally to the earlier-noted drops of dispersion.

The procedure with the 0.92 weight percent solution was also repeated with a cleaned polypropylene coupon. The treated area of the coupon was again clearly water-wetted, and dyeing with Safranine 0™ dye gave a continuous treated area of pale pink.

Examples 92–93

A sample of a sulfonated polystyrene (such as is commercially available from Aldrich Chemical Co., Inc.) containing 1 milliequivalent of acid groups per gram of polymer was dissolved in anhydrous dioxane to give a 1.1 weight percent solution of the sulfonated polystyrene. An acetone-washed, water-rinsed and dried PTFE coupon was immersed in part in the sulfonated polystyrene solution and allowed to drain. A continuous film was not formed, and after immersion in a 20 wt. percent solution of sodium bisulfate in water and dyeing with Safranine 0™ 3,7-diamino-2,8-dimethyl-5-phenyl-phenazinium chloride, dye, only isolated areas of the coupon were observed to have been coated and dyed.

A second sulfonated polystyrene solution was then prepared containing 1.2 wt. percent of the sulfonated polystyrene in a mixture of 48 weight percent dioxane with 52 weight percent of water, with the sulfonated polystyrene first being dissolved in the dioxane and then diluting with water. A cleaned PTFE coupon immersed in part in this solution showed a continuous film of the solution on the PTFE coupon surface. The wetted coupon portion was immersed in the same sodium bisulfate salt solution, and after water-rinsing was water-wetted in a continuous film. After being dyed with Safranine 0™ 3,7-diamino-2,8-dimethyl-5-phenyl-phenazinium chloride, dye, a continuous rose-colored area was observed with some variation in the shade being seen as well.

A polypropylene coupon was coated by the same procedure, and yielded a translucent, continuous water-wetted area which was a deep rose color on dyeing with the Safranine 0™ 3,7-diamino-2,8-dimethyl-5-phenyl-phenazinium chloride, dye.

Examples 94–100

An 800 equivalent weight ionomer was prepared by copolymerization of $CF_2{=}CF_2$ with $CF_2{=}CFOCF_2SO2F$ in an emulsion polymerization system. The resulting polymer was isolated and dried, and hydrolyzed with NaOH to give a perfluorinated sodium sulfonate form ionomer. After being water-washed to neutrality, the ionomer was converted to the acid ($H^+$) form by exposure to hydrochloric acid. After again being water-washed to neutrality and air-dried, the ionomer was charged with water only to a 300 mL stirred Parr bomb reactor. The vessel was closed, and heated to a selected temperature with stirring for about 2 hours while monitoring the system pressure. After cooling to ambient temperatures, the amount of ionomer in the dispersion (and from this, the yield of ionomer in the dispersion) was determined by drawing off a 15 to 20 gram sample of the liquid composition, evaporating to dryness and weighing the residue. The results are shown in Table 11:

TABLE 11

| Ionomer, (g) | Water (g) | P, in Psig (MPa) | Temp (°C.) | Wt. % Ionomer | Yield (%) |
|---|---|---|---|---|---|
| 6.2 | 200 | 230–240 (1.6–1.7) | 200 | 2.74 | 92 |
| 2.28 | 72.89 | 162 (1.1) | 185 | 2.68 | 89 |
| 2.35 | 76.04 | 163 (1.1) | 185 | 2.68 | 89 |
| 2.31 | 74.93 | 163 (1.1) | 185 | 2.63 | 88 |
| 2.21 | 71.46 | 145–163 (1.0–1.1) | 180–185 | 2.84 | 95 |
| 5.75 | 200.4 | 480–490 (3.3–3.4) | 240 | 2.67 | 93 |
| 6.2[a] | 200 | 230–240 (1.6–1.7) | 200 | 2.21 | 80 |

[a]Film form, all others being powders;

Example 101

Into a 50 gallon vessel, there were placed 292 pounds of water and 9 pounds of the ionomer employed in Examples 94–100, the ionomer having been converted as a powder to its acid form. The vessel was closed and heated at 180 to 185 degrees Celsius for 2 hours while stirring. The pressure was 130 psig. After cooling, the amount of polymer in the liquid phase was determined by evaporating a 15–20 gram sample to dryness and weighing the residue. The measured yield was 92 percent.

Example 102

The same vessel, ionomer and procedure were used as in Example 101, with 3 pounds of ionomer and 160 pounds of water being charged to the vessel. The temperature of this trial was 180 degrees Celsius, and the measured pressure reached 110 psig. The measured yield under these conditions was 98 percent.

Example 103

There were about 75 pounds of Teflon™ 7C PTFE powder and 225 pounds of water mixed at a tip speed of 6,600 ft./min. for 15 minutes, in a Cowles HLM Series, single shaft mount high shear dissolver (Morehouse-Cowles Inc., Fullerton, Calif. USA) equipped with a 6 inch diameter high-shear impeller, to preshear the PTFE powder to homogeneity.

After removing about 65 pounds of water, and while stirring at a tip speed of 4,350 ft./min., 40 pounds of a 2.75 weight percent dispersion of the 800 equivalent weight acid form ionomer of previous examples were added. After stirring for 10 minutes, a uniform slurry was obtained. About 21 pounds of dry sodium chloride and 4.5 pounds of 50 pct. NaOH were added to the slurry, and mixing was continued for another ten minutes. A homogeneous slurry was obtained with wetted, ionomer-coated PTFE.

Example 104

For this example, 45 grams of an acid form, shorter side chain ionomer of the type used in Examples 94–100 above, but having an equivalent weight of 980, was placed in a vessel with 1400 grams of water. The vessel was closed, and the water/polymer mixture heated with stirring to 196 degrees Celsius and a pressure of 189 psig for two hours. After cooling and evaporating a portion to dryness in the manner of Examples 94–100, the solids content of the dispersion was determined to be 2.82 percent by weight for a yield of from 94 to 95 percent (taking into account that the polymer when added to the vessel was not completely dried).

What is claimed is:

1. A process for coating a cation-containing polymer onto a substrate, which comprises:

contacting the substrate with a colloidal dispersion or solution of the cation-containing polymer; and then contacting the dispersion- or solution-wetted substrate, while still wetted with the colloidal dispersion or solution and without an intervening drying step, with a solution of a salt or of a strongly ionizing acid of a concentration to cause an adherent coating of the cation-containing polymer to form on the substrate.

2. A process as defined in claim 1, wherein a perfluorosulfonic acid ionomer is employed as the cation-containing polymer represented by $$-(CF_2-CF_2)_a(CF_2-\underset{\underset{O(CF_2CF(CF_3)O)_nCF_2CF_2SO_3H}{|}}{CF})_b-$$

wherein n is 1 or more and the ratio of a:b is about 7 to 1, or by $$-(CF_2-CF_2)_a(CF_2-\underset{\underset{OCF_2CF_2SO_3H}{|}}{CF})_b-$$

wherein the ratio of a:b is about 7 to 1, or which is an alkali metal-exchanged salt of one of these perfluorosulfonic acid ionomers.

3. A process as defined in claim 2, wherein the substrate is in the form of a fiber, powder, fabric or article of polytetrafluoroethylene, polyvinylidene fluoride, a fluorinated ethylene-propylene copolymer, poly(vinyl chloride), glass, polypropylene, carbon, steel, platinum, chlorotrifluoroethylene or a perfluoroalkoxyvinyl ether-tetrafluoroethylene copolymer.

4. A process as defined in claim 1, further comprising contacting the coated substrate with a solution containing a different cation, so that a different cation-exchanged form of the coated cation-containing polymer results.

5. A process as defined in claim 1 or as defined in claim 4, further comprising heat treating the coated substrate at an elevated temperature after a first coating of the cation-containing polymer has been applied to the substrate and has been contacted with the salt solution or the strongly ionizing acid, then contacting the heat-treated, coated substrate a second time with a colloidal dispersion or solution of a cation-containing polymer and then with a solution of a salt or strongly ionizing acid of a concentration to cause a second coating of cation-containing polymer to form on the first coating the substrate.

6. A process as defined in claim 5, which further comprises annealing the coated substrate at a glass transition temperature of the ionomer or greater.

7. A process as defined in claim 6, wherein the substrate is polymeric in nature and further, wherein the annealing of the coated substrate occurs at a crystalline melting point of the polymeric substrate.

8. A process as defined in claim 1, wherein a sulfonated polystyrene, a copolymer of a non-acid, ethylenically unsaturated monomer with an ethylenically unsaturated carboxylic monomer, or a perfluorocarbon ionomer is employed in the colloidal dispersion or solution for forming the coating on the substrate.

9. A process as defined in claim 8, wherein a perfluorosulfonic acid ionomer is employed as the cation-containing polymer represented by $$-(CF_2-CF_2)_a(CF_2-\underset{\underset{O(CF_2CF(CF_3)O)_nCF_2CF_2SO_3H}{|}}{CF})_b-$$

wherein n is 1 or more and the ratio of a:b is about 7 to 1, or by $$-(CF_2-CF_2)_a(CF_2-\underset{\underset{OCF_2CF_2SO_3H}{|}}{CF})_b-$$

wherein the ratio of a:b is about 7 to 1, or which is an alkali metal-exchanged salt of one of these perfluorosulfonic acid ionomers.

10. A process as defined in claim 1 or as defined in claim 9, wherein the colloidal dispersion or solution is employed for forming the coating on the substrate which when brought into contact with the substrate does not contain any solvent or any liquid medium other than water.

11. A process as defined in claim 10, wherein the substrate is in the form of a fiber, powder, fabric or article of polytetrafluoroethylene, polyvinylidene fluoride, a fluorinated ethylene-propylene copolymer, poly(vinyl chloride), glass, polypropylene, carbon, steel, platinum, chlorotrifluoroethylene or a perfluoroalkoxyvinyl ether-tetrafluoroethylene copolymer.

12. A process as defined in claim 10, wherein:

the substrate is polytetrafluoroethylene, polyvinylidene fluoride, poly(vinyl chloride), polypropylene, a fluorinated ethylene-propylene copolymer, chlorotrifluoroethylene or a perfluoroalkoxyvinyl ether-tetrafluoroethylene copolymer and is in the form of a powder, fibers or a mixture of powder and fibers; and contacting the substrate with the colloidal dispersion or solution involves adding the dispersion to the substrate and subjecting the mixture to high shear conditions.

13. A process as defined in claim 12, wherein the solventless dispersion or solution is formed of a perfluorosulfonic acid ionomer of the cation-containing polymer having the formula $$-(CF_2-CF_2)_a(CF_2-\underset{\underset{OCF_2CF_2SO_3H}{|}}{CF})_b-$$

wherein the ratio of a:b is about 7 to 1 and the ionomer has an equivalent weight of from about 550 to about 1000, the ionomer solids are combined with the substrate in a ratio by weight of 0.015 to 1 or greater, and the shearing of the mixture is accomplished with a blade on a blending device at a tip speed of 240 meters per minute or greater.

14. A process as defined in claim 13, wherein the perfluorosulfonic acid ionomer has an equivalent weight of from about 550 to about 800.

15. A process as defined in claim 14, wherein the substrate is polytetrafluoroethylene.

16. A process as defined in claim 13, wherein the substrate is polytetrafluoroethylene.

17. A process as defined in claim 12, wherein the substrate is polytetrafluoroethylene.

* * * * *